US005474046A

United States Patent [19]

Corona

[11] Patent Number: 5,474,046

[45] Date of Patent: Dec. 12, 1995

[54] FUEL INJECTION SYSTEM

[76] Inventor: José M. B. Corona, Atenas #307, Valle Dorado Tlalnepantla, Estado De Mexico, Mexico, CP 54020

[21] Appl. No.: 415,549

[22] Filed: Apr. 3, 1995

Related U.S. Application Data

[63] Continuation-in-part of Ser. No. 206,431, Mar. 7, 1994.

[51] Int. Cl.[6] ..... F02M 51/00

[52] U.S. Cl. ..... 123/478; 123/336; 123/337

[58] Field of Search ..... 123/478, 336, 123/472, 590

[56] References Cited

U.S. PATENT DOCUMENTS

| | | | |
|---|---|---|---|
| 4,365,600 | 12/1982 | Nakada et al. | 123/336 |
| 4,445,474 | 5/1984 | Nakao et al. | 123/336 |
| 4,452,218 | 6/1984 | Yokoyama et al. | 123/336 |
| 4,484,551 | 11/1984 | Choma et al. | 123/336 |
| 4,690,118 | 9/1987 | Hofbauer et al. | 123/472 |
| 4,716,879 | 1/1988 | Takayama et al. | 123/590 |
| 5,012,787 | 5/1991 | Hafner et al. | 123/472 |
| 5,337,719 | 8/1994 | Togai | 123/478 |
| 5,353,765 | 10/1994 | Saikalis et al. | 123/478 |

*Primary Examiner*—Raymond A. Nelli
*Attorney, Agent, or Firm*—Harrison & Egbert

[57] ABSTRACT

A fuel injection system for an internal combustion engine of a vehicle including a body having a first air channel and a second air channel formed therein, a fuel injection channel formed in the body, a first mixing chamber formed in the body between the fuel injection channel and one of the first and second air channels, a first valve means positioned in the first air channel for limiting a passage of air therethrough relative to movement of an accelerator of the vehicle, a second valve positioned in the fuel injection channel for limiting a passage of fuel relative to a movement of the accelerator, and a third valve positioned in the second air channel for limiting the flow of air/fuel therethrough relative to a movement of accelerator. The first air channel and the second air channel communicate with each other in the body. The first mixing chamber serves to mix fuel from the fuel injection channel with air from the second air channel. A plunger is positioned within the body adjacent the fuel injection channel so as to stop a flow of fuel through the fuel injection channel to the mixing chamber.

20 Claims, 3 Drawing Sheets

FUEL INJECTION SYSTEM

RELATED APPLICATION

The present application is a continuation-in-part application of U.S. application Ser. No. 08/206,431, filed on Mar. 7, 1994, and entitled "FUEL INJECTION SYSTEM", presently pending.

TECHNICAL FIELD

The present invention relates to internal combustion systems. More particularly, the present invention relates to fuel injection systems for vehicles.

BACKGROUND ART

Fuel injection systems are commonly used for internal combustion systems. These fuel injection systems serve to inject and dose fuel/air mixtures to the cylinders of the internal combustion engine. These systems serve to proportion the gasoline/air mixture depending on the desired requirements of the engine. Unfortunately, these prior art fuel injection systems do not accurately dose fuel based upon intake fuel pressure, atmospheric conditions, and engine conditions.

It is an object of the present invention to provide a fuel injection system that effectively doses fuel to the engine.

It is another object of the present invention to provide a fuel injection system that doses fuel to the engine based upon factors affecting the performance of the vehicle.

It is still another object of the present invention to provide a fuel injection system that allows for the interruption of fuel flow in response to a fuel demand of the engine.

It is still another object of the present invention to provide a fuel injection system that can increase the performance of a vehicle and increase fuel economy.

These and other objects and advantages of the present invention will become apparent from a reading of the attached specification and appended claims.

SUMMARY OF THE INVENTION

The present invention is a new system for the injection and dosing of fuel/air mixtures for internal combustion engines. This systems includes an electro-mechanical system which is fed with fuel and air at its input. This makes a dosage determined by the engine's temperature and atmospheric pressure. The mixture volume is determined by the position of the accelerator. The position of the accelerator will affect the mixture because of the intake manifold pressure. The present invention effectively determines and carries out the dosing of fuel based upon the intake fuel pressure, the position of the fuel control valve, and the accelerator position. Pressure is controlled in a chamber where the fuel is injected. The fuel flow can be interrupted under programmed circumstances, as, for example, when the engine slows down.

DETAILED DESCRIPTION OF THE INVENTION

Figure 1:
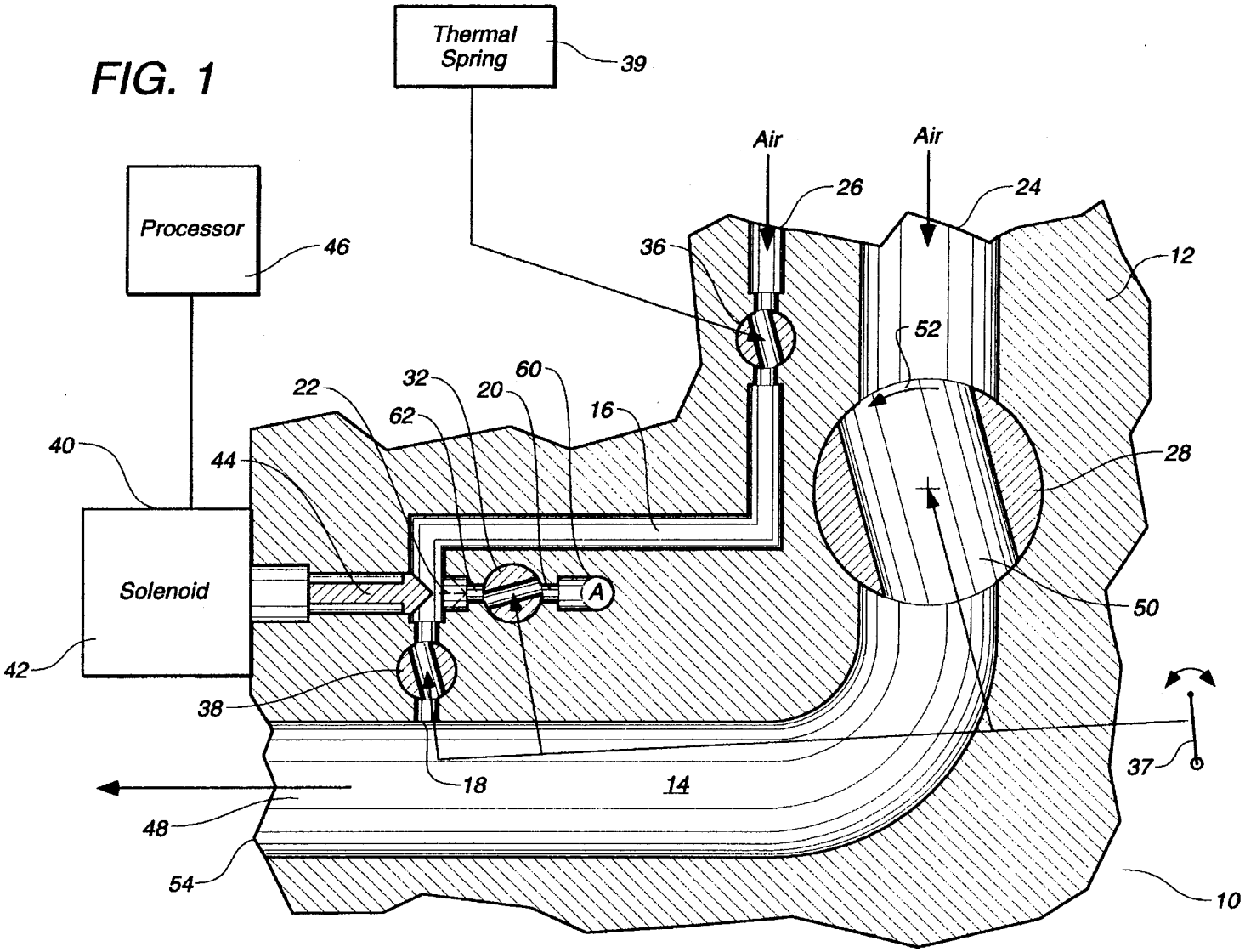
FIG. 1 is a cross-sectional view, in partial block diagram form, showing the fuel injection system in accordance with the present invention.

Referring to FIG. 1, there is shown at 10 the fuel injection system in accordance with the preferred embodiment of the present invention. The fuel injection system 10 includes a body 12 having a first air channel 14 and a second air channel 16. The first air channel 14 communicates with the second air channel 16 at outlet 18. A fuel injection channel 20 is formed in the body 12. A first mixing chamber 22 is formed in the body 12 between the fuel injection channel 20 and the second air channel 16. This first mixing chamber serves to mix fuel from the fuel injection channel 20 with air from the second air channel 16.

In FIG. 1, it can be seen that the first air channel 14 and the second air channel 16 open at inlet 24 and inlet 26, respectively, to the outside atmosphere. The air inlets 24 and 26 for each of the channels 14 and 16 allows air to enter the fuel injection system of the present invention in desired quantities. It can be seen that the inlet 24 for the first air channel 14 is of a greater diameter than the inlet 26 for the second air channel 16. As such, a greater volume of air can be drawn through the interior of the first air channel 14.

A first valve 28 is rotatably positioned in the first air channel 14 so as to limit the passage of air therethrough relative to a movement of an accelerator of the vehicle. A second valve 32 is rotatably positioned in the fuel injection channel so as to limit a passage of fuel relative to a movement of the accelerator. A third valve 36 is rotatably positioned in the second air channel 16 so as to limit a flow of air therethrough relative to a condition affecting the engine. Similarly, a fourth valve 38 can also be rotatably positioned in the second air channel 16 between the mixing chamber 22 and the first air channel 14 so as to limit a flow of air relative to a condition affecting the engine.

As can be seen in FIG. 1, the valves 28, 32, 36, and 38 are controlled relative to a position of the accelerator 37 or a condition affecting the engine. As such, the fuel/air mixture passing into and through the body 12 of the system 10 can be controlled relative to pertinent environmental and engine factors.

A plunger system 40 is positioned on the body 12 adjacent to the fuel injection channel 20. This plunger system 40 serves to stop a flow of fuel through the fuel injection channel 20 upon a predetermined condition. Specifically, the plunger system 40 includes a solenoid 42 which is connected to the body. A plunger member 44 extends from the solenoid 42 into the body 12. The plunger member 44 is movable so as to seal an end of the fuel injection channel 20 adjacent to the first mixing chamber 22. This position of the plunger member 44 is illustrated in broken lines in FIG. 1. Normally, the solenoid 42 is actuated so as to move the plunger member 44 into its sealing position in response to a fuel demand of the engine. As such, fuel flow is stopped whenever there is no demand for fuel by the engine. This will prevent any leakage of fuel in the air channels 14 or 16 and serve to conserve fuel. A processor 46 is electrically connected to the solenoid 42 so as to actuate the solenoid 42 in response to such fuel demands of the engine. For example, and as will be described in conjunction with FIG. 3, the processor 46 can actuate the solenoid whenever the intake manifold pressure drops or when the engine is turned off.

In FIG. 1, it can be seen that a second mixing chamber 48 is formed within the body 12. The second mixing chamber 48 is found within the first air channel 14. The second mixing chamber is positioned at the outlet 18 of the second air channel at the point where the second air channel 16 communicates with the first air channel 14. The second mixing chamber 48 serves to receive the air/fuel mixture from the first mixing chamber 22 as it passes through the valve 38.

In FIG. 1, it can be seen that the valves 28, 32, 36, and 38 are rotary valves that are rotatably positioned within the body along each of the channels. For example, the rotary valve 28 is positioned in the first air channel 14. This rotary valve 28 includes a central opening 50 which allows air to pass therethrough. When the valve 28 is rotated into the position shown in FIG. 1, the valve will serve to reduce the flow of air through the first air channel 14. Continued rotation of the rotary valve 28 in the direction of arrow 52 in FIG. 1 will further serve to reduce the flow of air through the channel 14. The rotation of the rotary valve 28, in the opposite direction, will increase the flow of air through the channel 14 (depending on the intake manifold pressure affecting the outlet 54 of the channel 14). The other valves 32, 36, and 38 operate in a similar manner. The first valve 28 and the second valve 32 are being mutually cooperative in relation to a movement of the accelerator. For example, if the accelerator is actuated, then the air flow 14 should increase and the fuel flow should increase also. As such, the rotary valves 28 and 32 will simultaneously move into a position whereby maximum air and maximum fuel will pass through the central opening of such rotary valves. As pressure is lifted from the accelerator pedal, the valves 28 and 32 will rotate so as to reduce the flow of air and to reduce the flow of fuel through their respective channels. As will be described hereinafter, stepper motors are connected to each of the valves so as to cause the controlled movement of such valves.

In contrast, either of the valves 36 and/or 38 can be operated based upon environmental conditions. For example, to control the amount of air mixing with the fuel in the first mixing chamber 22, the rotary valve 36 should close so as to increase the amount of fuel per unit of air. On the other hand, if a maximum amount of air is to be provided with the fuel, then valve 36 should be opened so as to allow the maximum flow of air therethrough. A thermal spring 39 can be used for actuating the movement of valve 36. Typically, valves 36 and 38 can rotate relative to a condition of the engine or to an atmospheric condition. As an example, valve 36 should be opened wider when the vehicle is operated at high altitudes (where air pressure is less). Valve 38 can operate based upon the position of the accelerator so as to allow a maximum amount of air/fuel mixture to pass into the mixing chamber 48.

Figure 2:
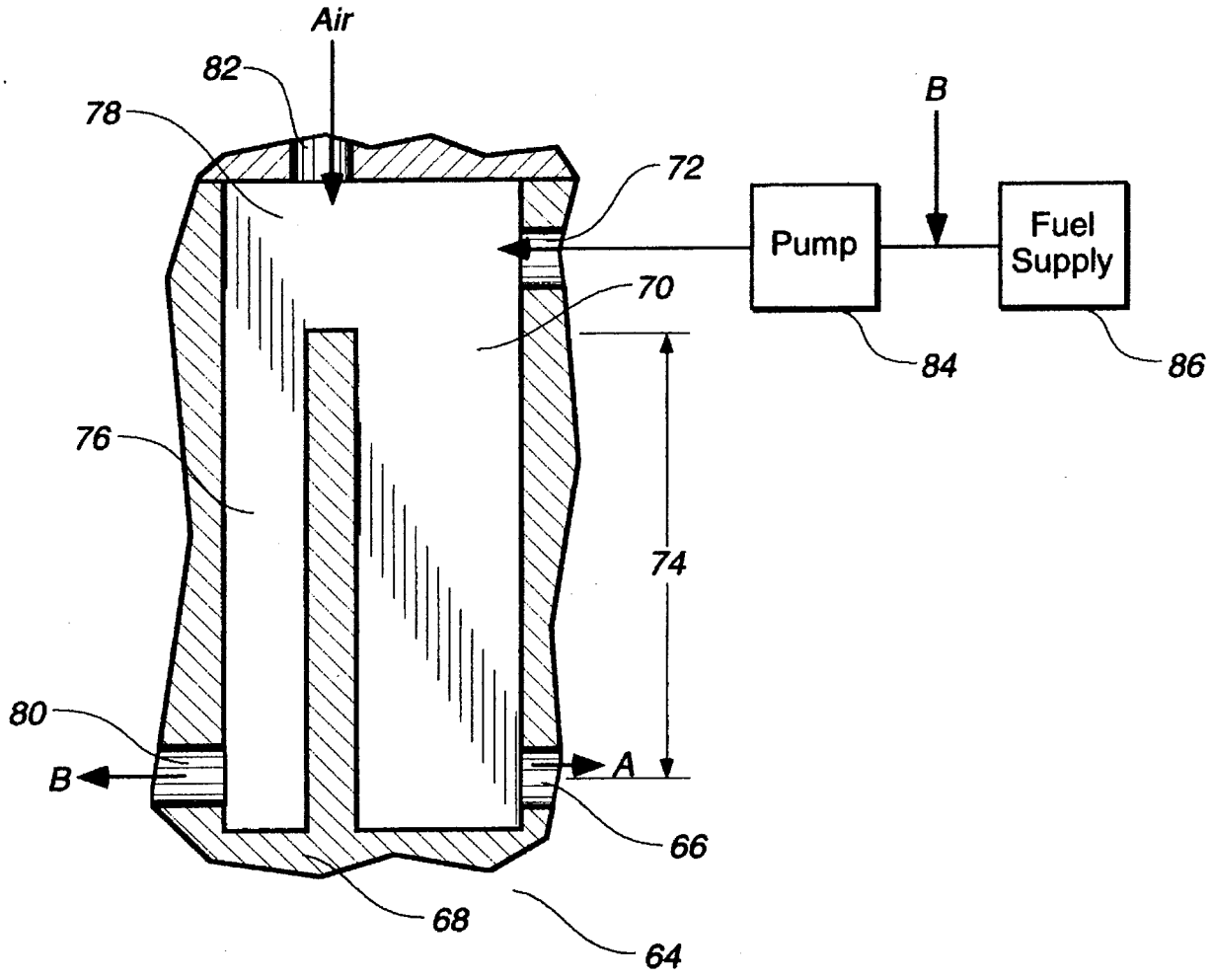
FIG. 2 is a cross-sectional illustration of the fuel pump which is used with the fuel injection system of FIG. 1.

The fuel injection channel 20 includes an inlet port 60 and an outlet port 62. The rotary valve 32 is positioned between the inlet port 60 and the outlet port 62. Importantly, the present invention includes a unique configuration of the fuel pump for the purposes of supplying fuel to the inlet port 60. The configuration of this fuel pump is illustrated at 64 in FIG. 2. Initially, the fuel pump 64 should be configured so that a constant flow of fuel under a desired pressure is supplied to the inlet port 60. The fuel pump 64 is connected to the fuel injection channel 20 at the inlet port 60. The letter "A" represents where the outlet 66 of the fuel pump 64 joins the inlet port 60 of the fuel injection channel 20.

The fuel pump 64 includes a body 68 having a fuel chamber 70 with an inlet 72 and an outlet 66. As can be seen, the fuel chamber 70 has a given height 74 which corresponds to a desired fuel pressure which enters the fuel injection channel 20. An overflow chamber 76 is fluidically connected at passageway 78 to the fuel chamber 70. The overflow chamber 76 receives fuel when the fuel chamber 70 is filled above the desired height 74. The overflow chamber 76 includes an overflow outlet 80. An air inlet 82 is provided so as to communicate a reference pressure to the fuel chamber 70. A pump 84 is connected to a supply of fuel 86 and to the inlet 72 of the fuel chamber 70. This pump 84 serves to pass fuel from the fuel supply 86 into the fuel pump 64. As can be seen, the fuel passing from the overflow chamber 76 will pass through the outlet 80 and into a fuel line passing to the pump 84. This passage of fuel is represented by the letter "B" indicated in FIG. 2. In this arrangement, any fuel exiting the fuel outlet 66 will pass into the fuel injection channel 20 under constant pressure.

Figure 3:
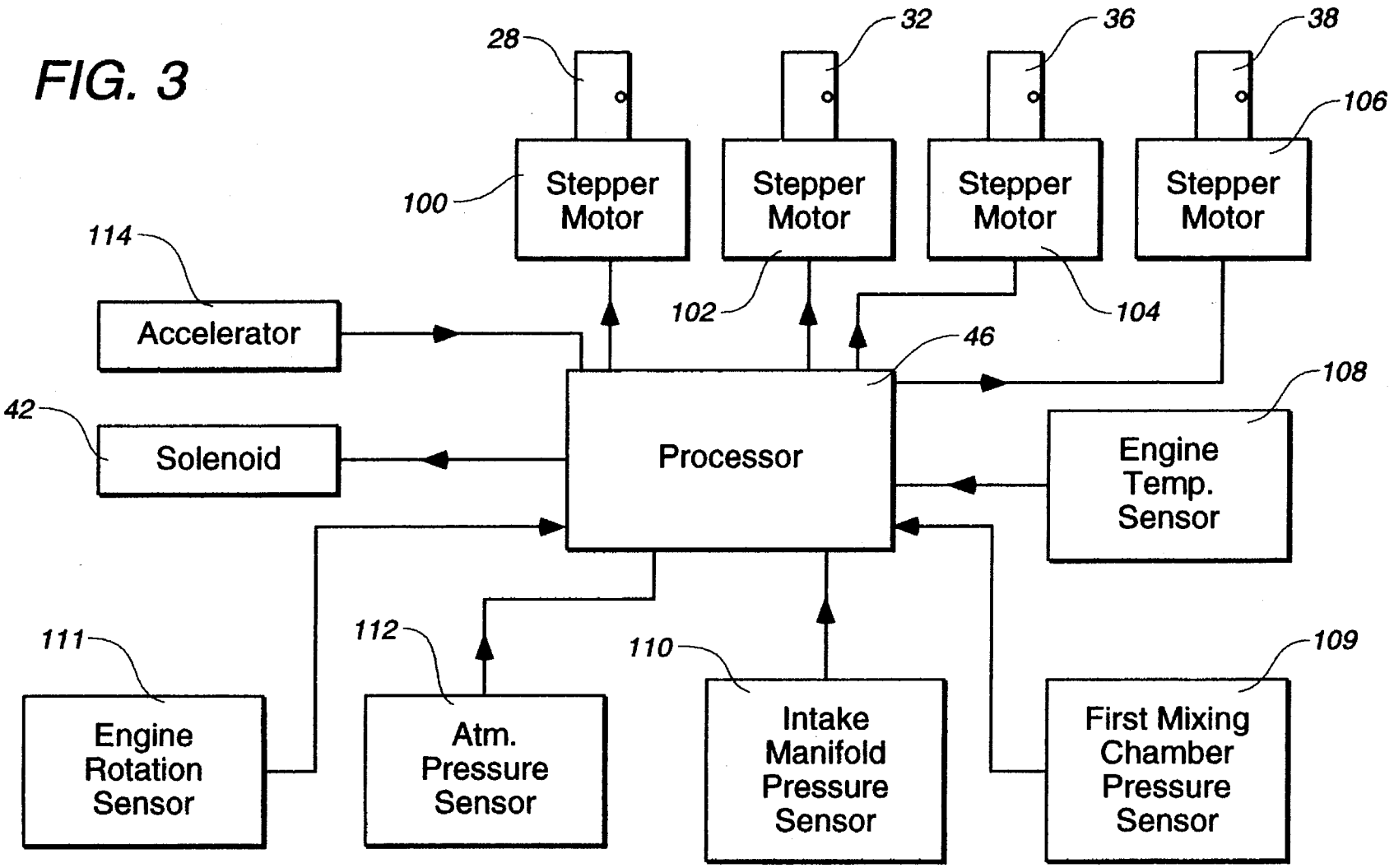
FIG. 3 is a block diagram showing the operation of the fuel injection system of the present invention.

FIG. 3 shows a block diagram of the operation of the fuel injection system of the present invention. Initially, in FIG. 3, it can be seen that the processor 46 has several outputs which are connected to stepper motors 100, 102, 104, and 106 of rotary valves 28, 32, 36, and 38, respectively. As such, the proper electrical signal passing from the processor 46 will actuate a stepper motor so as to rotate the rotary valve into its respective and proper positions. The processor can transmit a signal to such stepper motors based upon a variety of inputs that are received from the engine. As can be seen, the processor 46 receives inputs from an engine temperature sensor 108, from a first mixing chamber pressure sensor 109, from an engine rotation sensor 111, from an intake manifold pressure sensor 110, and from an atmospheric pressure sensor 112. Additionally, the accelerator 114 will serve to provide an input to the processor 46. As was described hereinbefore, the information obtained from the sensors 108, 110, and 112 can serve to cause the opening of the respective rotary valves to a desired position. Similarly, the position of the accelerator 114 will cause the simultaneous movement of the first rotary valve 28 and the second rotary valve 32. The processor 46 also can send information to the solenoid 42 so as to actuate the plunger member 44 for the closing of fuel flow. For example, if the intake manifold pressure sensor 110 shows a drop in pressure, than the solenoid 42 can be activated so as to prevent fuel flow from entering the mixing chamber.

The fuel injection system 10 of the present invention provides the fuel/air mixture to internal combustion engines at close to the ideal proportions. The mixture amount which is provided is controlled by the accelerator which commands appropriate mechanisms in order to control the opening of the respective valves. The output of the mixing chamber 48 will pass directly to the intake manifold of the internal combustion engine.

In the present invention, the air flow volume induced is determined by the air pressure at the air inlet 24, by the first rotary valve 28, and by the existing suction from the intake manifold. The fuel flow volume is determined by the fuel pressure at the inlet port 60, by the position of the rotary valve 32, and by the exiting pressure at the first mixing chamber 22. The pressure at the first mixing chamber 22 is determined by the pressure of the intake manifold present in the second mixing chamber 48, the pressure at the air inlet 26 of the second air channel 16, and by the relationship between the respective open areas of the rotary valves 36 and 38.

The opening of the rotary valve 38 is determined by the position of the accelerator. The opening of the rotary valve 36 is determined by the combined action of a thermal spring and a device which compares the atmospheric pressure with a referenced pressure or by the processor 46 controlling a stepper motor. As such, an adequate opening is given to the valve 36 upon the engine's temperature and atmospheric pressure.

It is important to note that the valves 36 and 38 control the pressure of the first mixing chamber 22. As a result, either of the valves 36 or 38 could be fixed and the other controlled so as to vary the opening area. As such, it is possible to incorporate a single valve into the second air channel 16, instead of the dual arrangement described herein previously.

The plunger mechanism 40 serves to disable the injection of fuel under circumstances when the engine is at a non-operational condition. Additionally, it serves to shut down fuel flow when the engine slows down. This stoppage of fuel flow is indicated by a pressure switch which senses the intake manifold pressure or through other mechanisms.

It is also possible that the system 10 of the present invention can be operated in parallel so as to feed separate pistons within an engine.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A fuel injection system for an internal combustion engine of a vehicle comprising:

a body having a first air channel and a second air channel formed therein, said first air channel communicating with said second air channel in said body;

a fuel injection channel formed in said body;

a first mixing chamber means formed in said body between said fuel injection channel and one of said first and second air channels, said first mixing chamber means for mixing fuel from said fuel injection channel with air from said one of said first and second air channels;

a first valve means positioned in said first air channel for limiting a passage of air therethrough relative to movement of an accelerator of the vehicle;

a second valve means positioned in said fuel injection channel for limiting a passage of fuel relative to a movement of the accelerator; and a third valve means positioned in said second air channel for limiting a flow of air therethrough relative to a condition affecting the engine.

2. The system of 1, further comprising:

a plunger means positioned in said body adjacent said fuel injection channel, said plunger means for stopping a flow of fuel through said fuel injection channel to said mixing chamber.

3. The system of 2, said plunger means comprising:

a solenoid connected to said body; and a plunger member extending into said body, said plunger member movable so as to seal an end of said fuel injection channel.

4. The system of 3, further comprising:

a processor means connected to said solenoid, said processor means for actuating said solenoid in response to a fuel demand of the engine.

5. The system of 1, said first air channel having a greater diameter than said second air channel, said first air channel having one end opening to an exterior of said body, said first air channel having another end communicating with an intake manifold of the engine.

6. The system of 5, said first air channel having a second mixing chamber means formed within said body, said second mixing chamber means positioned at an outlet of said second air channel, said second mixing chamber means for receiving an air/fuel mixture from said first mixing chamber means.

7. The system of 1, said first valve means and said second valve means being mutually cooperative in relation to the movement of the accelerator.

8. The system of 1, said first valve means comprising:

a rotary valve rotatably positioned in said body in said first air channel; and a stepper motor means operatively connected to said rotary valve for rotating said valve in response to a movement of the accelerator.

9. The system of 1, said fuel injection channel having an inlet port and an outlet port, said outlet port opening to said first mixing chamber means, said second valve means comprising:

a rotary valve rotatably positioned in said body between said inlet port and said outlet port of said fuel injection channel; and a stepper motor means operatively connected to said rotary valve for rotating said valve in response to a movement of the accelerator.

10. The system of 1, said second air channel having one end opening to the atmosphere, said second air channel having another end opening to said first air channel, said first mixing chamber means formed along said second air channel.

11. The system of 10, said third valve means comprising:

a first rotary valve rotatably positioned in said body between said one end of said second air channel and said first mixing chamber means; and a second rotary valve rotatably positioned in said body between said first mixing chamber means and said other end of said second air channel.

12. The system of 11, said third valve means further comprising:

a first stepper motor operatively connected to said first rotary valve for rotating said valve in response to an atmospheric or engine condition; and a second stepper motor means operatively connected to said second rotary valve for rotating said valve in response to a movement of the accelerator.

13. The system of 12, said first valve means comprising:

a third rotary valve positioned in said body in said first air channel; and a third stepper motor means operatively connected to said third rotary valve for rotating said third rotary valve in response to a movement of the accelerator.

14. The system of 13, said fuel injection channel having an inlet port and an outlet port, said outlet port opening to said first mixing chamber means, said second valve means comprising:

a fourth rotary valve rotatably positioned in said body between said inlet port and said outlet port of said fuel injection channel; and a fourth stepper motor means operatively connected to said fourth rotary valve for rotating said fourth rotary valve in response to a movement of the accelerator.

15. The system of 1, further comprising:

a fuel pump means connected to said fuel injection channel, said fuel pump means for passing fuel into said fuel injection channel at generally constant pressure.

16. The system of 15, said fuel pump means comprising:

a fuel chamber having an inlet and an outlet, said outlet connected to said fuel injection channel of said body, said chamber having a given height corresponding to a desired fuel pressure entering said fuel injection channel.

17. The system of 16, said fuel pump means further comprising:

an overflow chamber fluidically communicating with said fuel chamber, said overflow chamber receiving fuel when said fuel chamber is filled above said desired height, said overflow chamber having an overflow outlet port formed therein.

18. The system of 17, said fuel pump means further comprising:

a pump connected to a supply of fuel and to said inlet of said fuel chamber, said pump for passing fuel from said supply and from said overflow chamber to said fuel chamber, said overflow outlet fluidically connected to said pump.

19. The system of 4, said processor means further comprising:

a plurality of sensors electrically connected thereto, said plurality of sensors for sensing engine temperature, intake manifold pressure, and engine rotation.

20. The system of 19, said processor means further comprising:

a first mixing chamber pressure sensor electrically connected thereto, said processor means for controlling said third valve means relative to engine rotation speed, intake manifold pressure, engine temperature, and first mixing chamber pressure.

* * * * *